United States Patent [19]

Moyaert

[11] Patent Number: 4,702,545

[45] Date of Patent: Oct. 27, 1987

[54] CONTACT SPRING

[75] Inventor: Werner Moyaert, Jabbeke, Belgium

[73] Assignee: Siemens Aktiengesellschaft, Berlin and Munich, Fed. Rep. of Germany

[21] Appl. No.: 940,949

[22] Filed: Dec. 12, 1986

[30] Foreign Application Priority Data

Dec. 13, 1985 [DE] Fed. Rep. of Germany ..... 3544223

[51] Int. Cl.[4] ..... H01R 13/11

[52] U.S. Cl. ..... 439/856

[58] Field of Search ..... 339/258 R, 258 P, 277 R

[56] References Cited

U.S. PATENT DOCUMENTS

| | | | |
|---|---|---|---|
| Re. 29,513 | 1/1978 | Johnson | 339/112 R |
| 3,659,243 | 4/1972 | Gluntz | 339/192 R |
| 3,832,770 | 9/1974 | Gluntz | 29/630 D |
| 4,175,821 | 11/1979 | Hunter | 339/258 R |
| 4,536,055 | 8/1985 | Kandybowski et al. | 339/258 R |
| 4,598,972 | 7/1986 | Mullen, III et al. | 339/258 R |

FOREIGN PATENT DOCUMENTS

| | | |
|---|---|---|
| 2066502 | 7/1971 | France . |
| WO86/02131 | 4/1986 | PCT Int'l Appl. . |

*Primary Examiner*—Joseph H. McGlynn

*Attorney, Agent, or Firm*—Hill, Van Santen, Steadman & Simpson

[57] ABSTRACT

A contact spring is formed of a strip of spring sheet metal which is divided at one end into at least two and preferably three parallel webs, the two outer webs being longer and bent-back in a U-shape and connected at their free ends to one another by a cross piece which is immediately the U-shaped bend. The cross piece realizes a first contact surface while the shorter middle web has its free end residing opposite the cross piece to form a second contact surface. In the nonbent condition, the contact surfaces lie in the same region and are closely adjacent one another so that a band of spring sheet metal which includes a precious metal layer at only one side in a narrow region of the contact surfaces can be used to manufacture the contact springs. When two webs are provided, a longer one has a transverse arm and is bent-back adjacent the end of the shorter web.

8 Claims, 4 Drawing Figures

CONTACT SPRING

BACKGROUND OF THE INVENTION

1. Field of the Invention

The present invention relates generally to a contact spring formed of a sheet metal strip so that a recess is formed for plugging in a contact pin or blade.

2. Description of the Prior Art

A contact spring is disclosed in U.S. Pat. Re. No. 29,513. The disclosed contact spring has a bent-back section dimensioned relatively long to achieve an adequate spring path and, thus, a contact blade for use with the contact spring must also be of a relatively great length to be able to reach the contact surface formed by the free end of the bent-back section. Moreover, the contact face which is at the unbent side of the strip is relatively rigid so that the contact force of the contact spring must be generated largely by the bent section. To save costs in the disclosed contact spring, only the actual contact surfaces are provided with a precious metal layer for cooperating contact with the contact blade or pin. When the known contact spring is in the unbent condition, the contact faces lie relatively far apart so that precious metal must be applied to two regions separated relatively far from one another for every contact spring.

SUMMARY OF THE PRESENT INVENTION

It is an object of the present invention to provide a contact spring wherein both contact faces of the spring are resiliently yielding and, further, the two contact faces, when the spring is in the unbent condition, follow one another as immediately as possible so that a coating process can be simply designed to give a precious metal coating to the contact faces.

These and other objects of the present invention are achieved in a contact spring wherein a first of two oppositely residing contact faces is formed from sheet metal strip by a region bent-back in a U-shape and following immediately upon the U-shaped bend. A second one of the two contact faces is formed by a free end of a tongue or web cut free from the sheet metal strip in a running direction of the strip, wherein the free end of the tongue is provided immediately adjacent the U-shaped bend.

In this way, two contact faces between which a contact pin is insertable are as close as possible to the end of the contact spring that is immediately adjacent to the plug-in opening for a contact pin. This is accomplished without the spring effect of the contact spring being deteriorated.

In a further development of the invention, the first contact face is a component part of an arm or cross piece directed transversely relative to the running direction of the strip of which the contact spring is formed. The strip is either divided into two webs parallel to one another in a direction towards the contact faces with one arm connected to the bent-back U-shaped web and the tongue formed by the other web, or, the strip is formed of three parallel webs in a direction toward the contact faces and an arm is formed as a cross piece or arm connecting two outer longer webs which are bent-back U-shaped and the tongue is formed by a shorter middle web.

DESCRIPTION OF THE PREFERRED EMBODIMENTS

Figure 1:
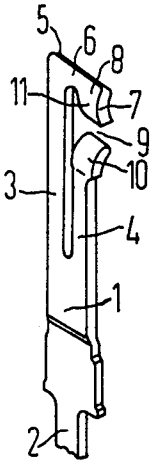
FIG. 1 is a perspective view of a contact spring according to the principles of the present invention in an unbent condition.

In FIG. 1, the contact spring is manufactured of a strip 1 of spring sheet metal which has one end formed into a pin-shaped or blade-shaped connecting member 2 by means of a punching operation, the connecting member 2 possibly being thereafter bent depending on the application. The strip 1 of sheet metal has its other end divided into two webs 3 and 4 extending parallel and adjacent to one another in the running direction of the strip 1. At a free end 5, the longer of the two webs 3 includes an arm 6 or cross piece transversely extending relative to the running direction of the strip 1. The arm 6 is broadened at a free end 7 and is dimensioned such that it is separated from the web 4 by an air gap 9 when in the nonbent condition of the strip 1. The free end 7 has a wide portion 8 arranged as an extension of the shorter web 4. The widened portion, or broadening, 8 may be curved somewhat.

The shorter web or tongue 4 is provided at its free end with an arc which forms a contact surface 10 of the contact spring in the region of the arc.

Figure 2:
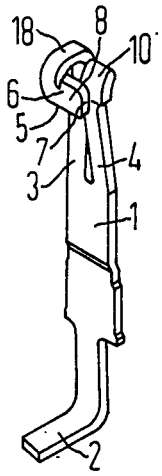
FIG. 2 is a perspective view of the contact spring of FIG. 1 in its finished condition.

With reference to FIG. 2, the arm 6 has its widened portion 8 disposed opposite the contact surface 10 of the shorter web 4 by bending the longer web 3 in a U-shaped bend 18. The widened portion 8 of the arm 6 forms a second contact surface 11 which lies opposite the contact surface 10 of the shorter web 4.

The air gap 9, which is between the contact surfaces 10 and 11 when the longer web 3 is in the nonbent condition, forms an insertion opening now that the web 3 is in the bent position through which a contact pin or contact blade (not shown) may be inserted between the contact surfaces 10 and 11. As can be seen from FIGS. 1 and 2, the contact surfaces 10 and 11 are provided at one end of the contact spring immediately adjacent the bend 18 of the longer web 3. Thus, a contact spring or a contact blade does not require great length to proceed between the contact surfaces 10 and 11. Further, both contact surfaces 10 and 11 are component parts of resiliently yielding webs 4 and 3, respectively. The contact surfaces 10 and 11 thereby apply themselves against the contact pin or blade inserted between these surfaces with an optimum spring effect.

Figure 3:
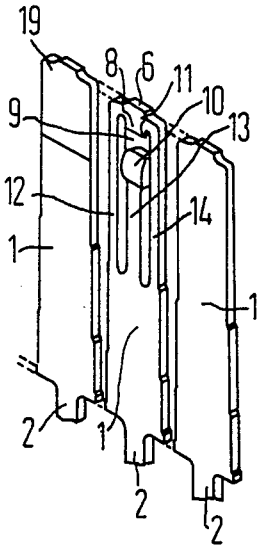
FIG. 3 is a perspective view of a second embodiment of the present contact spring in various stages of manufacture to illustrate the forming of the contact spring from a band of spring sheet metal.
Figure 4:
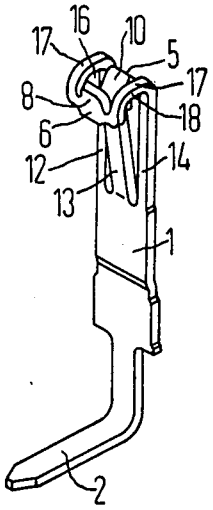
FIG. 4 is a perspective view of a finished contact spring of the second embodiment.

An exemplary embodiment is shown in FIGS. 3 and 4 wherein a strip 1' is divided into three parallel webs 12, 13, and 14 at the end of the strip which is opposite the connecting member 2. The two outer webs 12 and 14 are connected to one another at their free end by an arm or cross piece 6', wherein the arm 6' includes a widened portion, or broadening, 8' at its midsection. The widened portion 8' is formed as an extension of the shorter arm 12 which is separated from the widened portion 8' in the running direction of the strip 1' by an air gap 9' when the two outer webs 12 and 14 are in their nonbent condition.

The widened portion 8' of the arm 6' is disposed opposite a free end 15 of a shorter one of the webs 13 by bending the outer webs 12 and 14 with a U-shaped bend 18'. The surfaces of the wide portion 8' of the arm 6' and the free end 15 of the short web 13 are formed as opposing contact surfaces 10' and 11' between which a contact pin or blade (not shown) can be inserted. The contact pin or blade is inserted through a window 16 which is formed by bent regions 17 of the longer webs 12 and 14.

As can be seen in FIG. 3, the individual sheet metal strips 1' can be worked from a sheet metal band, the strips 1' preceding in the band as rungs on a ladder. As a result of such arrangement and of the specific design of the contact spring, the contact surfaces 10' and 11' of each contact spring are situated at the same side of the sheet metal band and are, moreover, concentrated at a narrow region 19 of the strip 1'. The single narrow region 19 makes it particularly simple to coat the contact surfaces 10' and 11' of the strip 1' with precious metal by applying the precious metal to the region 19 on the sheet metal band from which the contact spring is formed.

Although other modifications and changes may be suggested by those skilled in the art, it is the intention of the inventor to embody within the patent warranted hereon all changes and modifications as reasonably and properly come within the scope of his contribution to the art.

I claim as my invention:

1. A contact spring, comprising:

a sheet metal strip defining a longitudinal extent;

a strip section at one end of said strip having a U-shaped bend opposite the longitudinal extent of said strip;

a recess in the region of said bend to accept a contact element;

a first contact surface formed by a portion of said strip section bent-back by said U-shaped bend and immediately adjacent said bend;

a tongue cut free from said sheet metal strip along the longitudinal extent; and a second contact surface formed by a free end of said tongue, said free end of said tongue disposed immediately adjacent said U-shaped bend and opposite said first contact surface.

2. A contact spring as claimed in claim 1, further comprising:

an arm transversely extending relative to the longitudinal extent, said first contact surface being a portion of said arm.

3. A contact spring as claimed in claim 2, wherein said sheet metal strip is divided into first and second parallel extending webs in the direction of said first and second contact surfaces, said arm extends from said first web that includes said U-shaped bend, and said tongue is formed by said second web.

4. A contact spring as claimed in claim 2, wherein said sheet metal strip is divided into first, second, and third parallel webs in the direction of said first and second contact surfaces, said first and third parallel webs being longer than said second web and disposed at either side of said second web;

said arm forming a cross piece connecting said first and third longer webs;

said first and third webs bent-back in said U-shaped bend; and said tongue formed by said shorter second web.

5. A contact spring for engaging contact pins and the like, comprising:

an elongated strip of sheet metal having first and second opposite ends;

a connecting member formed at said first end of said elongated strip;

at least two webs formed in said second end of said elongated strip in the direction of a longitudinal extent of said elongated strip, said webs being parallel to one another, one of said at least two webs being shorter than others of said at least two webs and forming a tongue having a first contact surface at a free end, the other of said at least two webs having a second contact surface adjacent said first contact surface, said other of said at least two webs being bent in a U-shaped bend adjacent a free end to place said second contact surface opposite said first contact surface.

6. A contact spring as claimed in claim 5, further comprising:

an arm extending transversely from said other of said at least two webs and including said second contact surface on said arm, said arm being disposed as an extension of said one of said at least two webs when said other of said at least two webs is not bent.

7. A contact spring as claimed in claim 6, wherein two webs are provided, a longer one of said two webs having said arm extending transversely and being bent in a U-shaped bend.

8. A contact spring as claimed in claim 6, wherein three of said webs are provided, a middle one of said three webs being shorter than outer ones of said webs, and said outer ones of said webs connected together by said arm and bent in a U-shaped bend.

* * * * *